United States Patent [19]

Kämpf

[11] 4,411,052

[45] Oct. 25, 1983

[54] METHOD FOR MANUFACTURING AN ULTRASONIC TRANSDUCER ARRANGEMENT

[75] Inventor: Erich Kämpf, Erlangen, Fed. Rep. of Germany

[73] Assignee: Siemens Aktiengesellschaft, Berlin and Munich, Fed. Rep. of Germany

[21] Appl. No.: 265,455

[22] Filed: May 20, 1981

[30] Foreign Application Priority Data

May 21, 1980 [DE] Fed. Rep. of Germany ..... 3019420

[51] Int. Cl.[3] ..... H04R 17/00

[52] U.S. Cl. ..... 29/25.35; 29/854

[58] Field of Search ..... 29/25, 35, 840, 854–856; 310/334, 335, 364; 339/17 F

[56] References Cited

U.S. PATENT DOCUMENTS

| | | | |
|---|---|---|---|
| 3,421,961 | 1/1969 | Joyce | 29/854 |
| 3,952,387 | 4/1976 | Iinuma et al. | 29/25.35 |
| 4,060,889 | 12/1977 | Zielinski | 29/854 |
| 4,092,057 | 5/1978 | Walton | 339/17 F |
| 4,173,035 | 10/1979 | Hoyt | 339/17 F |

*Primary Examiner*—Carl E. Hall
*Assistant Examiner*—P. W. Echols
*Attorney, Agent, or Firm*—Kenyon & Kenyon

[57] ABSTRACT

A method for manufacturing an ultrasonic transducer arrangement with groups of jointly controlled transducer elements, in which the metal coating of a contact foil is connected to a strip-shaped piezoelectric body, and the piezoelectric body, with the metal coating, is subsequently subdivided, in which the parts of the contact foil overhanging at the ends of the transducer elements are separated into contact tabs for individual transducer groups at both ends with one tab connected to a control conductor and the other tab forming electrically conducting bridges for the transducer elements of its transducer group. The bridges increase the operating reliability of the transducer arrangement produced, in that each transducer element is provided with an electrical lead at both its ends.

1 Claim, 2 Drawing Figures

METHOD FOR MANUFACTURING AN ULTRASONIC TRANSDUCER ARRANGEMENT

BACKGROUND OF THE INVENTION

This invention relates to ultrasonic transducers in general and more particularly to an improved method of manufacturing ultrasonic transducers.

Copending patent application U.S. application Ser. No. 265,449 discloses a method for manufacturing an ultrasonic transducer arrangement with transducer elements which are provided with contact tabs made of a contact foil. According to this method, at least one flat side of a plastic foil serving as the contact foil is provided with a metal deposit which is undetachably connected to a flat side of a strip-shaped piezoelectric body. The other flat side of the contact foil is fastened to a damping body, whereupon a subdivision of the piezoelectric body is carried out. According to a further embodiment of the method, a divided contact foil can be used, the metal coating of which is then connected to a respective edge zone of the piezoelectric body only in the edge region. The piezoelectric body is likewise provided with metallization on its flat sides. In the ultrasonic transducer arrangement to be manufactured, several respective adjacent transducer elements are to form a transducer group of transducer elements which are acoustically separated and are electrically controlled in common.

The contact foil always forms a common feed for the electric transducer elements of a transducer group having elements which are electrically connected in parallel. For acoustical reasons, a very thin contact foil is chosen, the thickness of which generally does not exceed 10 μm appreciably and is preferably considerably less than 10 μm. The thickness of the metal coating is still substantially smaller than the thickness of the contact foil. It must always be connected undetachably to a narrow side of the transducer elements, the width of which, in an ultrasonic transducer array with several hundred transducer elements for high frequencies of, for instance, 5 MHz and more, can, in some circumstances, be considerably less than 100 μm. The contact foil must therefore be connected to a correspondingly narrow surface part of the transducer elements. If sufficient contact is not brought about over this small surface area during the soldering operation or if the solder connection opens up again during the subsequent, generally mechanical subdivision of the piezoelectric body, the current supply to this transducer element is interrupted and this element therefore will not be active during the operation of the ultrasonic transducer arrangement. In the subsequent subdivision of the piezoelectric body for making the individual transducer elements, the cuts are taken perpendicularly to the flat sides of the piezoelectric body to such a depth that even the electrically conducting surface layer of the contact foil is mechanically separated between the individual transducer elements. The parts of the contact foil which remain at the ends of the transducer element and serve as the current lead for one of the transducer elements are therefore no wider than the tranducer elements produced and their mechanical strength is accordingly low. In connecting the contact tab, to be made later, to an electric control lead, which is in general located on a control plate, the connection to one of the transducer elements can be interrupted by mechanical damage. The electric lead can furthermore be disturbed by a crack formation in the metal coating in the vicinity of the end faces of the transducer elements.

SUMMARY OF THE INVENTION

It is an object of the present invention to increase the operating reliability of an ultrasonic transducer arrangement of this type and, in particular, to prevent the electric leads to the individual transducer elements from being interrupted by mechanical damage.

According to the present invention, this problem is solved by connecting the transducer elements of each transducer group to the metallic part of a contact foil having parts overhanging the transducer elements at both ends which are separated into contact tabs. One contact tab is connected to a control conductor and the other forms electrically conducting bridges for the transducer elements of the transducer group. These design features ensure that each transducer element has an electric lead at both its ends. If the electric lead at one end is interrupted, then this element receives current via the conducting bridges of at least one of the adjacent transducer elements, and the operating reliability of the overally arrangement is thus increased accordingly.

DETAILED DESCRIPTION OF THE INVENTION

Figure 1:
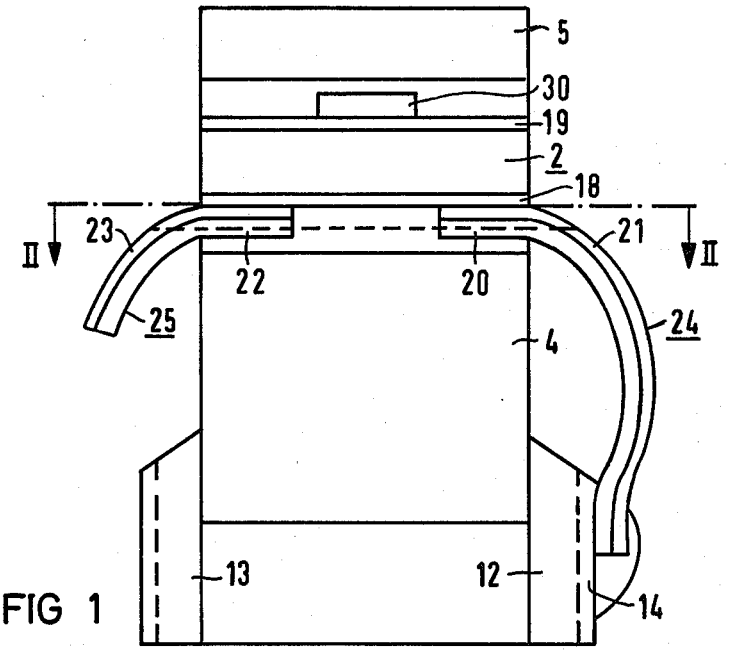
FIG. 1 is a schematic cross section of an ultrasonic transducer arrangement according to the present invention.

In the embodiment according to FIG. 1, an ultrasonic transducer arrangement contains a linear arrangement of transducer elements 2 which are to be arranged one behind the other, between a damping body 4 and a matching body 5, in a direction perpendicular to the plane of the drawing. The transducer elements 2 can be made by so-called fine division of a strip-like or slab-like piezoelectric body. On the two lateral surfaces of the damping body 4 respective conductor plates 12 and 13 are arranged. The surfaces of conductor plates 12 and 13 are provided with electric conductors, of which only one, conductor 14, is designated in the figure. These conductors serve as control conductors for the transducer elements 2 and are each connected to a contact tab 24 which is made from a part of a separated contact foil protruding from the arrangement at the end faces of the transducer elements 2. The parts of the separated contact foils are designated as 20 and 22 in the figure. Part 22 of the contact foil is likewise provided with an extending tab 25 which overhangs at the end of the transducer elements 2. A common electrical return line for the current supply of the transducer elements 2 is formed by a conductor 30 of electrically conductive material, of which only the end face is visible in the figure. Conductor 30 is connected via a conductor, not shown in the figure, on one of the conductor plates 12 and 13, to the other pole of the current supply.

The contact foil parts 20 and 22 are each provided with metal plating 21 and 23 which is undetachably connected to a metallization layer 28, for instance, by soldering. The common electrical return line 30 for the transducer elements 2 is likewise connected to a metallization layer 19 at the upper narrow side of the transducer elements 2. The transducer elements 2 are made through subdivision of the piezoelectric body by taking a cut through the piezoelectric body with the metallization of its flat sides to such a depth that at least the metallization of the contact foil parts 20 and 22 is also cut open, as is indicated in the figure by a dashed line. Thereby, the individual transducer elements 2 with their metallization 18 and 19 are separated from each other acoustically as well as mechanically. The spaces between the individual transducer elements 2 may optionally be filled, after the acoustic separation, with a filler, the acoustic impedance of which is substantially different from the acoustic impedance of the piezoelectric material of the transducer elements 2.

Figure 2:
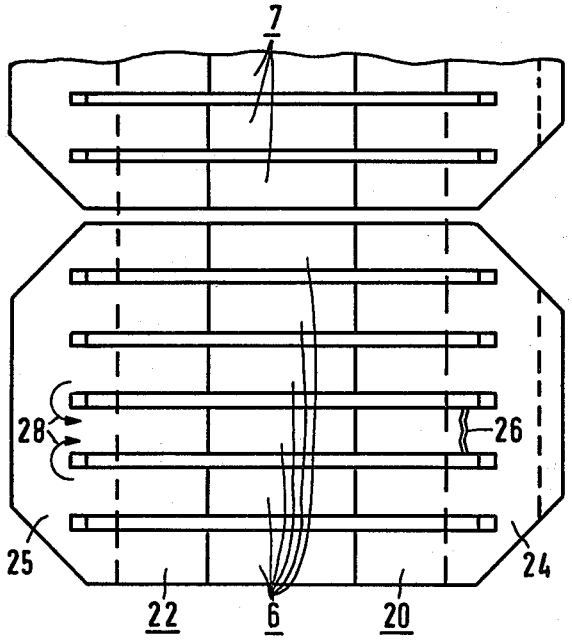
FIG. 2 is a cross section through FIG. 1 showing the contact foil.

FIG. 2, illustrates the contact foil parts 20 and 22. The part of the foil overhanging at the right-hand end of the transducer elements forms the contact tab 24 which is connected to an electric control conductor, such as conductor 14 on plate 12 and forms the electric lead for a transducer group 6 made up of elements 2. The cuts of the subdivision can advantageously be taken so that the contact tabs between the transducer group 6 made up of elements 2 and the transducer group 7 made up of elements 2 are separated by one of the cuts. At the other end of the transducer elements, the contact tab 25 forms electrically conducting bridges between the transducer elements of the elements 6 of the transducer group. If, for instance, the current supply from the contact tab 24 to one transducer element 2, of the transducer group 6 is interrupted by a crack, such as crack 26, then this transducer element 2 is supplied with current via a current path including the contacts of the part 20 of the contact foil at the two adjacent transducer elements 2, the metallization 18 at the transducer elements 2 and the electrically conducting bridges of the contact tab 25, as is indicated in the figure by arrows 28. The current to one of the transducer elements 2 within the transducer groups 6 and 7 can therefore be interrupted only if the current leads are interrupted at both ends of a transducer element.

What is claimed is:

1. In a method for the manufacture of an ultrasonic transducer arrangement having transducer elements which are provided with contact tabs of a contact foil, in which at least one flat side of a plastic foil serving as the contact foil is provided with a metal coating, and at least one flat side of a strip-shaped piezoelectric body is connected undetachably to a surface area of the metal coating of the contact foil, the other flat side of said contact foil being fastened to a damping body, and in which the piezoelectric body is subdivided into elements, several adjacent transducer elements forming a transducer group of transducer elements which are acoustically separated and electrically controlled in common, the improvement comprising:

(a) connecting transducer elements of the respective transducer groups to the metallic part of a contact foil having parts overhanging at both ends of the transducer elements, said contact foil separated into contact tabs for the individual transducer groups;

(b) connecting the tab at one end to a control conductor; and (c) using the tab at the outer end to form electrically conductive bridges for the transducer elements of its transducer group.

* * * * *